US005816839A

United States Patent [19]

Muta

[11] Patent Number: 5,816,839

[45] **Date of Patent: *Oct. 6, 1998**

[54] ELECTRICAL CONNECTION STRUCTURE AND METHOD

[75] Inventor: Junji Muta, Yokkaichi, Japan

[73] Assignee: Sumitomo Wiring Systems, Ltd., Yokkaichi, Japan

[ * ] Notice: The term of this patent shall not extend beyond the expiration date of Pat. No. 5,586,901.

[21] Appl. No.: 565,578

[22] Filed: Nov. 30, 1995

[30] Foreign Application Priority Data

Dec. 7, 1994 [JP] Japan ..... 6-331120

[51] Int. Cl.[6] ..... H01R 13/64

[52] U.S. Cl. ..... 439/342; 439/376

[58] Field of Search ..... 439/376, 342, 439/374

[56] References Cited

U.S. PATENT DOCUMENTS

| | | | |
|---|---|---|---|
| 4,445,740 | 5/1984 | Wallace | 439/152 |
| 4,698,025 | 10/1987 | Silbernagel et al. | 439/79 |
| 5,167,520 | 12/1992 | Henry et al. | 439/266 |
| 5,204,565 | 4/1993 | Sekine et al. | 439/855 |
| 5,586,901 | 12/1996 | Muta | 439/342 |

FOREIGN PATENT DOCUMENTS

| | | |
|---|---|---|
| 0 600 418 A1 | 11/1993 | European Pat. Off. . |
| 4-80258 | 7/1992 | Japan . |
| 4-80259 | 7/1992 | Japan . |

*Primary Examiner*—Gary F. Paumen
*Assistant Examiner*—T C Patel
*Attorney, Agent, or Firm*—Oliff & Berridge, PLC

[57] ABSTRACT

An electrical connector assembly includes a male connector, a female connector, a guiding portion and a positioning portion. The male connector has a male connector housing with a terminal side through which male terminals extend. The female connector has a female connector housing with female terminals disposed to connect with the male terminals through a terminal side of the female connector housing. In a preferred embodiment, the guiding portion guides the female connector in a guiding direction that intersects a normal axis extending perpendicular to the terminal side of the male connector. The positioning portion stops the female connector upon contacting the positioning portion in a position at which the male terminals are aligned with the female terminals. As a result, a reliable electrical connection can be established even if the space for fitting the male and female connectors together is limited.

21 Claims, 6 Drawing Sheets

ELECTRICAL CONNECTION STRUCTURE AND METHOD

BACKGROUND OF THE INVENTION

1. Field of the Invention

The present invention relates to an electrical connection structure for connectors, and more particularly to an electrical connection structure suited for use when space for fitting connectors together is limited.

2. Brief Description of the Prior Art

One example of a construction in which the space for fitting connectors is limited is a connector device for direct connection to a motor, which is mounted, for example, on a drive portion of a power window of an automobile. This connector device is mounted on a housing having, at a motor output shaft-side, receiving portions within which an output shaft of the motor and speed reduction gears that engage the output shaft are mounted, respectively. At a position remote from the gear receiving portion adjacent to the output shaft-receiving portion, a pair of male metal terminals, connected to a brush of the motor, are mounted tab portions of the male metal terminals parallel to the output shaft of the motor, thus constituting a male connector. A mating female connector within which female metal terminals are disposed is adapted to be fitted on the male connector.

When the female connector is to be fitted on the male connector, the female connector is usually aligned with the male connector from a side towards which a front end of each tab portion is directed. However, in many cases, mounting legs for mounting the housing on a body project in front of the tab portion. As a result, the fitting space is so limited that the connector-fitting operation can not be completed easily.

Under these circumstances, a connector construction (as disclosed in Japanese Utility Model Unexamined Publication No. 4-80258) in which a female connector is disposed laterally and is fitted relative to a male connector from a lateral side, that is, in a direction intersecting longitudinal axes of tab portions of the male connector, is known.

In such a conventional construction, although the efficiency of the fitting operation can be enhanced, the tab portion of each male metal terminal is fitted in an associated female metal terminal in intersecting relation to each other. Therefore, the area of contact between the two is smaller compared to an ordinary type of construction in which male and female metal terminals are fitted together along the length thereof. The smaller area of contact, however, is not fully satisfactory from the viewpoint of the reliability of the electrical connection.

SUMMARY OF THE INVENTION

In view of the problems described above, an object of the invention is to provide an electrical connection structure in which even if a connector-fitting space is limited, female and male metal terminals can be fitted together with a large area of contact therebetween without lowering the efficiency of the fitting operation.

Another object of the invention is to provide a construction in which a mating connector can be guided with a simple construction.

Still another object of the invention is to provide a construction in which a mating connector can be moved without shaking so that metal terminals can be connected together without gouging.

Yet another object of the invention is to provide a construction in which two connectors, when fitted together, are locked against easy disengagement.

These and other objects are achieved by the electrical connector assembly of the claimed invention, which includes a male connector, a female connector, a guiding portion and a positioning portion. The male connector includes a male connector housing with a terminal side through which male terminals extend. The female connector includes a female connector housing with female terminals disposed to connect with the male terminals through a terminal side of the female connector housing. The guiding portion guides either the male connector or the female connector in a guiding direction that intersects a normal axis extending perpendicular to the terminal side of the other connector. The positioning portions stops the guided connector upon contact with the positioning portion in an alignment position such that the male terminals of the male connector are aligned with the female terminals of the female connector.

The guiding portion preferably includes a guide plate attached to the other connector and a guide plate groove shaped to receive the guide plate formed in the guided connector. The guided connector is preferably disposed relative to the other connector such that the guiding direction is substantially perpendicular to the normal axis extending from the terminal side of the other connector. The guiding portion preferably includes a limitation portion and the guided connector preferably includes a guide groove shaped to receive the limitation portion in the alignment position. As a result, the limitation portion engages the guide groove when the male connector and the female connector are urged together. The guide groove preferably extends approximately perpendicular to the guiding direction such that engagement between the guide groove and the limitation portion prevents movement of the guided connector in the guiding direction.

The electrical connector assembly preferably includes a locking mechanism that locks the male connector and the female connector to each other when the male connector and the female connector in the alignment position are urged towards each other. The locking mechanism preferably includes locking members attached to the male connector and corresponding locking members attached to the female connector. The locking members are disposed to engage the corresponding locking members when the male connector and the female connector in the alignment position are urged towards each other.

The guiding portion preferably includes a guide plate that projects by a first height from the terminal side between the terminals of either the male connector or the female connector. The guided connector preferably includes a guide plate groove that extends in the guiding direction and is shaped to receive the guide plate. The guide plate preferably includes guide surfaces disposed on at least one side of the guide plate at a second height less than the first height, the guide surface surfaces slidably supporting the guided one of the male connector and the female connector. The guide surface is preferably includes limitation portions that pertrude outward from the guide plate in a direction approximately perpendicular to the guiding direction.

The positioning portion preferably includes a positioning member shaped contact the housing of the guided connector. The positioning portion is preferably an abutment wall that contacts the guided connector. The abutment wall is preferably disposed approximately parallel to the terminals of and perpendicular to the terminal side of the other connector. The terminals of the female connector are preferably L-shaped and include female terminal end portions disposed approximately perpendicular to female terminal wire connection portions.

BRIEF DESCRIPTION OF THE DRAWINGS

Preferred embodiments of connectors of the invention for direct connection to a motor will now be described with reference to the accompanying drawings.

DETAILED DESCRIPTION OF PREFERRED EMBODIMENTS

Figure 1:
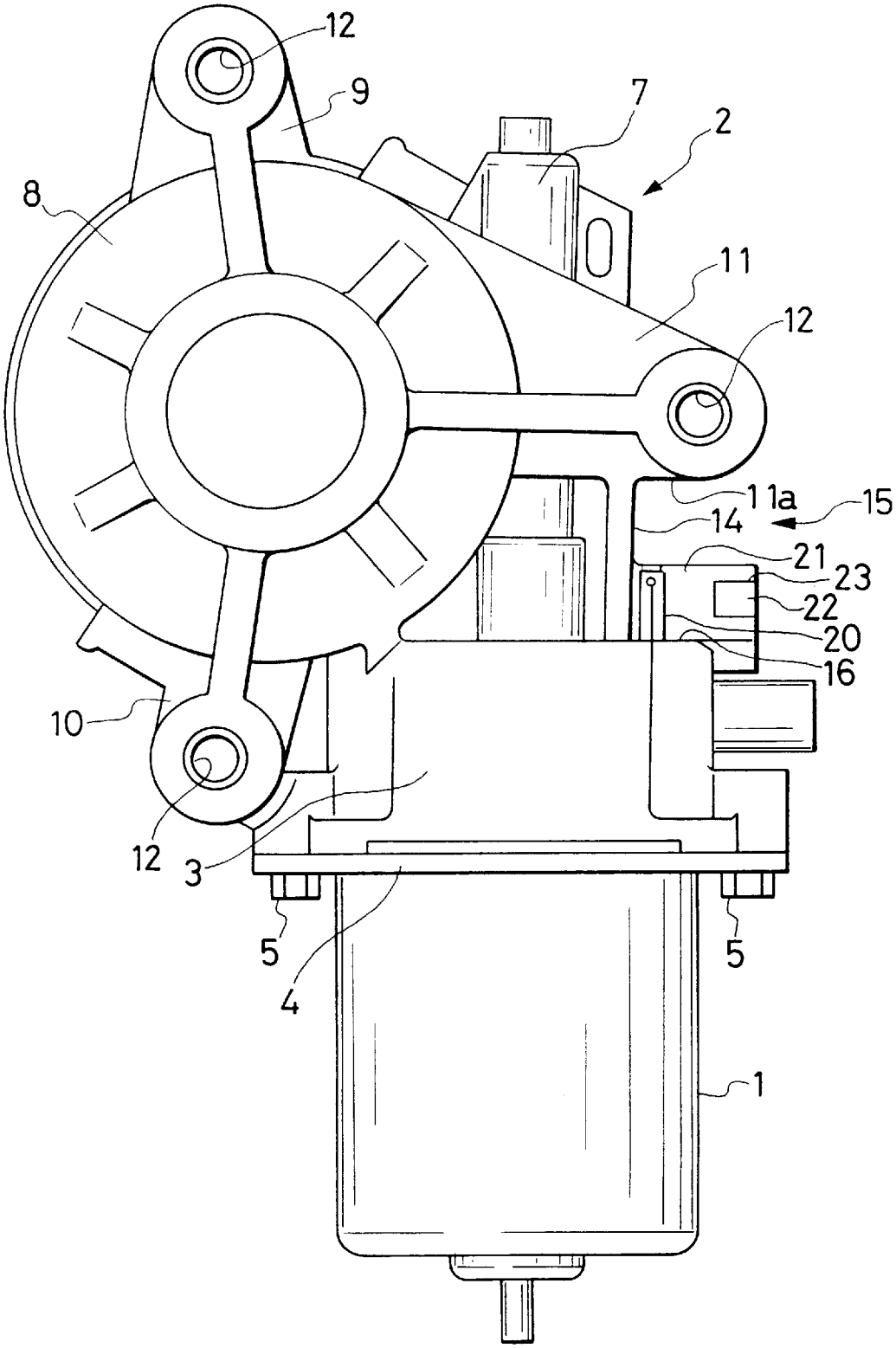
FIG. 1 is a front-elevational view of a first embodiment of a connector of the invention connected directly to a motor.

FIGS. 1 to 6 show a first embodiment of the invention. In FIG. 1, a housing 2 is mounted on one end portion of a motor 1 from which a motor output shaft is projected.

The housing 2 is molded of a synthetic resin in a single piece. A mounting portion 3 of this housing is mated with and fastened to a mounting flange 4 of the motor 1 by screws 5, and covers the mounting-side end of the motor 1. The housing 2 has an output shaft-receiving portion 7 in which the output shaft of the motor 1 is rotatably received, the output shaft-receiving portion 7 being in communication with the mounting portion 3. A gear receiving portion 8 is formed on one side of the output shaft-receiving portion 7, and a gear, meshed with a worm gear formed on the output shaft, is rotatably received by the gear receiving portion 8. Three mounting legs 9,10,11 are formed on the outer periphery of the gear receiving portion 8 at spaced intervals extending in a radial direction. The two mounting legs 9 and 10 are disposed generally at the top and bottom of the gear mounting portion 8, respectively, and the other mounting leg 11 extends in a direction away from the gear receiving portion 8 to project across the output shaft-receiving portion 7. A mounting hole 12 is formed through a distal end of each of the mounting legs 9,10,11. The housing 2 is fastened to a fixing member, such as a vehicle body, by screws passing respectively through the mounting holes 12.

Figure 2:
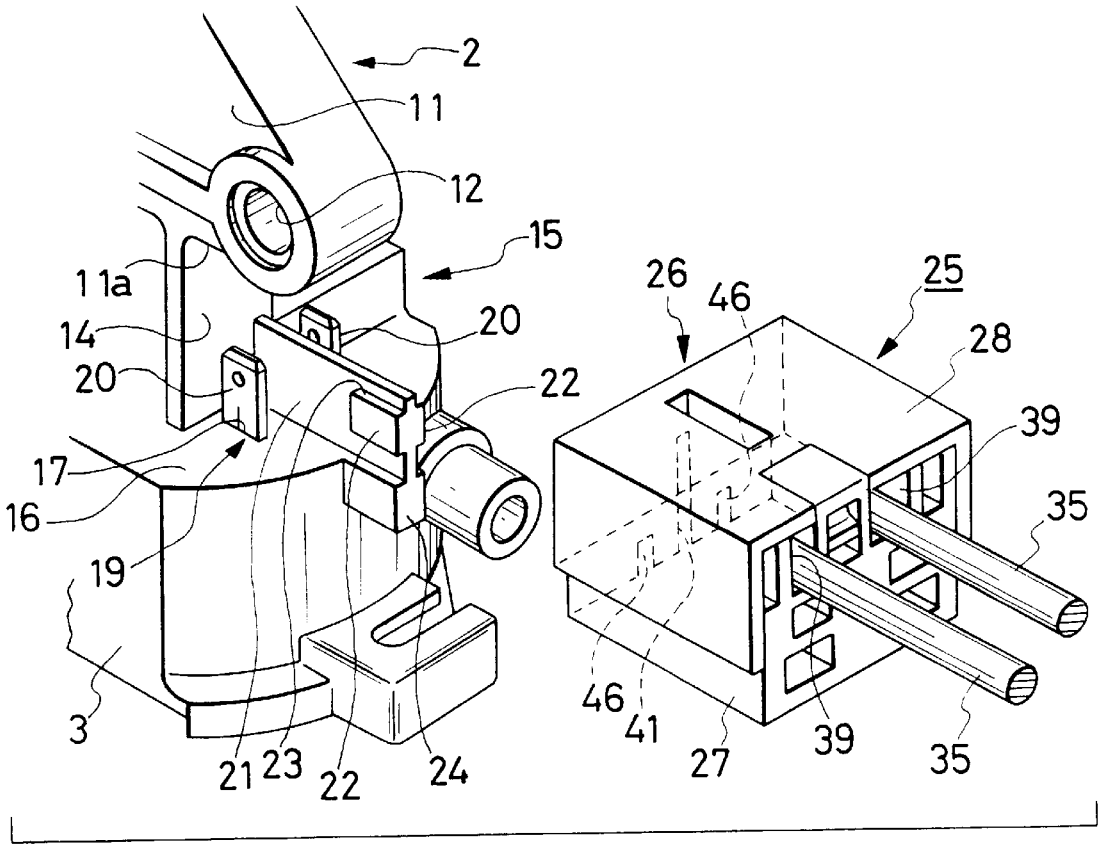
FIG. 2 is an exploded perspective view showing fitting portions of male and female connectors of the first embodiment.

An abutment wall 14 is formed between the lower surface of the mounting leg 11 and the upper surface of the mounting portion 3, and is disposed adjacent to the output shaft-receiving portion 7. The abutment wall extends approximately parallel to the output shaft-receiving portion 7. A male connector 15 is formed at the outer side of the abutment wall 14. As shown in FIG. 2, two holes 17, which are elongate in a direction perpendicular to the abutment wall 14, are formed in a bottom surface 16 (defined by the upper surface of the mounting portion 3) of the male connector 15, and are disposed adjacent to an outer surface of the abutment wall 14. The two holes 17 are spaced by a predetermined distance from each other in a direction parallel to the abutment wall 14. A pair of male metal terminals 19, connected to a brush (not shown) of the motor 1, are provided at the bottom surface 16 of the male connector 15 such that a tab portion 20 of each terminal 19 projects upwardly through the associated hole 17 by a predetermined distance from the bottom surface 16.

A guide plate 21 is formed integrally on that portion of the bottom surface 16 of the male connector 15 disposed intermediate the two tab portions 20, and extends perpendicularly to the abutment wall 14. The guide plate 21 extends upwardly to a height or level generally equal to that of the upper ends of the tab portions 20. The guide plate 21 has such a length that it projects by a predetermined distance outwardly from the peripheral edge of the bottom surface 16. A pair of limitation portions 22 are formed respectively on opposite sides of that portion of the guide plate 21 projecting outwardly from the bottom surface 16.

The limitation portions 22 have a flat, rectangular parallelepiped shape, and their upper surfaces serve as sliding surfaces 23 parallel to the bottom surface 16 of the male connector 15. More specifically, a bottom surface of a mating female connector 25 (described below) can be brought into sliding contact with the sliding surfaces 23 of the limitation portions 22 so that the female connector 25 can be pushed in parallel relation to the bottom surface 16 of the male connector 15. The dimension between the sliding surface 23 of each limitation portion 22 and a lower surface 11*a* of the mounting leg 11 is generally equal to the height of the female connector 25 (see FIG. 4). A reinforcing portion 24 of a larger thickness extends from the outer peripheral surface of the mounting portion 3, and is integrally formed on the lower surface of that portion of the guide plate 21 projecting outwardly from the peripheral edge of the bottom surface 16 of the male connector 15 to support the projecting portion.

Figure 3:
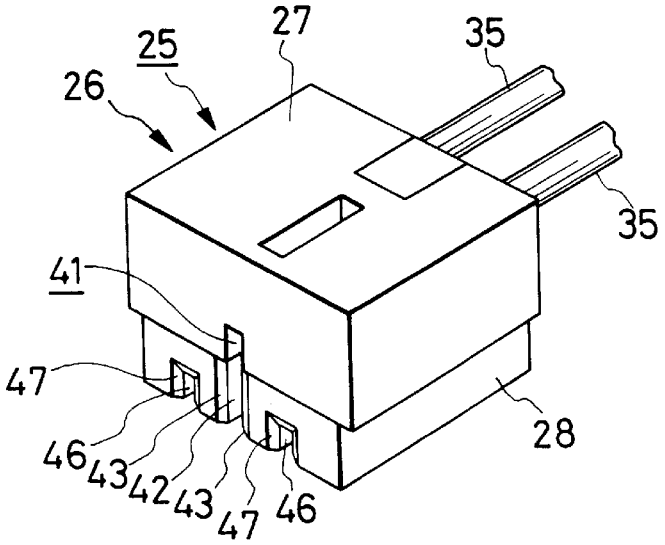
FIG. 3 is a perspective view of the female connector.
Figure 5:
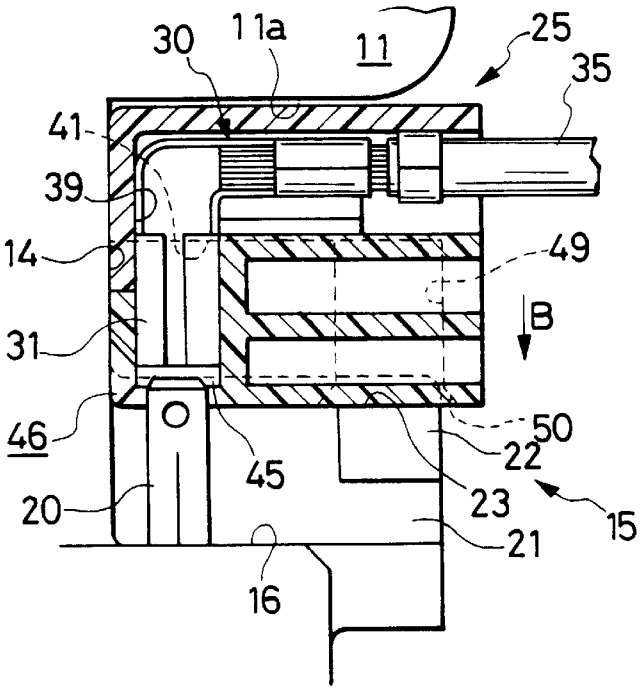
FIG. 5 is a vertical cross-sectional view showing the female connector fitted in a direction perpendicular to the tab portions.

The female connector 25 includes a housing 26 fabricated of a synthetic resin. The housing 26 includes a body portion 27 and a lid portion 28 which is fitted on the body portion 27 such that the lid portion 28 covers an upper surface of the body portion 27, opposite (right and left) side surfaces thereof and an upper portion of a front surface thereof. As a result, the housing 26 has a generally rectangular parallelepiped shape, as shown in FIGS. 2 and 3. As described above, the housing 26 of the female connector 25 has a height dimensioned such that the housing 26 can be inserted between the sliding surfaces 23 of the limitation portions 22 and the lower surface 11*a* of the mounting leg 11. The housing 26 is slightly larger in length than the guide plate 21, as shown in FIG. 5. A pair of female metal terminals 30 for fitting respectively on the tab portions 20 of the male metal terminals 19 are disposed within the housing 26.

Figure 4:
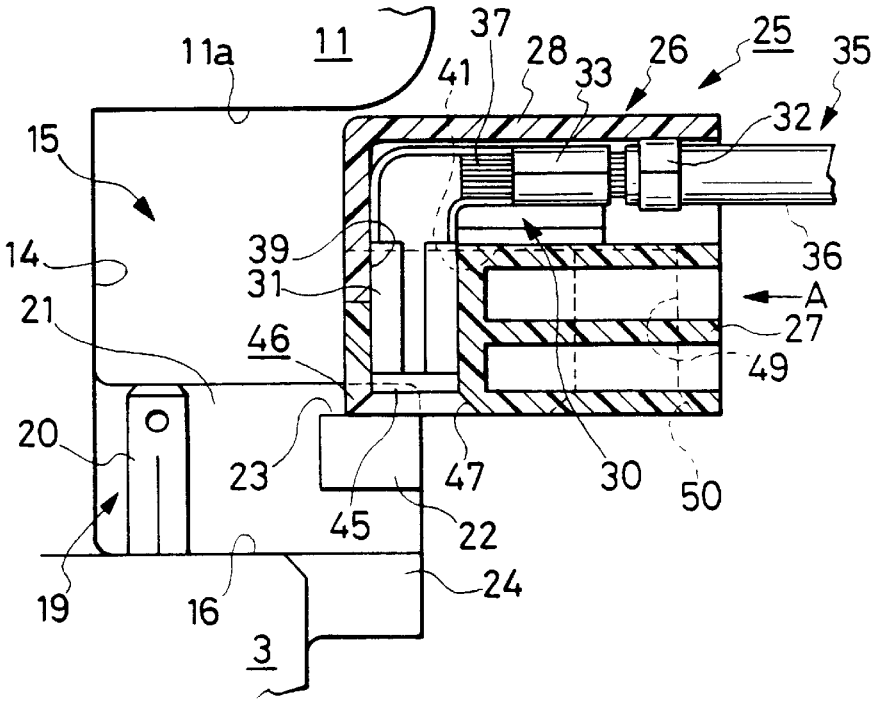
FIG. 4 is a vertical cross-sectional view showing an initial stage of fitting of the female connector.

The female metal terminal 30 is generally L-shaped as shown in FIG. 4, and opposite side edge portions of its front end portion are folded to form a connection portion 31 into which the tab portion 20 of the male metal terminal 19 can be inserted to establish contact between the female metal terminal 30 and the male metal terminal 19. An insulation barrel 32 and a wire barrel 33 are formed at the proximal portion of the female metal terminal 30. An end portion of a sheath 36 of a wire 35 is clamped by the insulation barrel 32, and a conductor 37, projecting from the end of the sheath 36, is clamped by the wire barrel 33, thereby connecting the wire 35 to the female metal terminal 30.

A pair of terminal receiving chambers 39 for respectively receiving the female metal terminals 30 are formed in the housing 26 of the female connector 25. Each terminal receiving chamber 39 extends at an upper portion of the housing 26 from a rear surface (right surface in FIG. 4) thereof to a position slightly short of a front surface thereof, and further extends perpendicularly therefrom toward a lower or bottom surface thereof, so that the terminal receiving chamber 39 has an L-shaped cross-section. To assemble the female connector 25, the lid portion 28 is detached from the body portion 27, each female metal terminal 30 is inserted into the body portion 27 from the upper side thereof, and the lid portion 28 is attached to the body portion 27 so that each female metal terminal 30 is held in the associated terminal receiving chamber 39 against movement.

Figure 6:
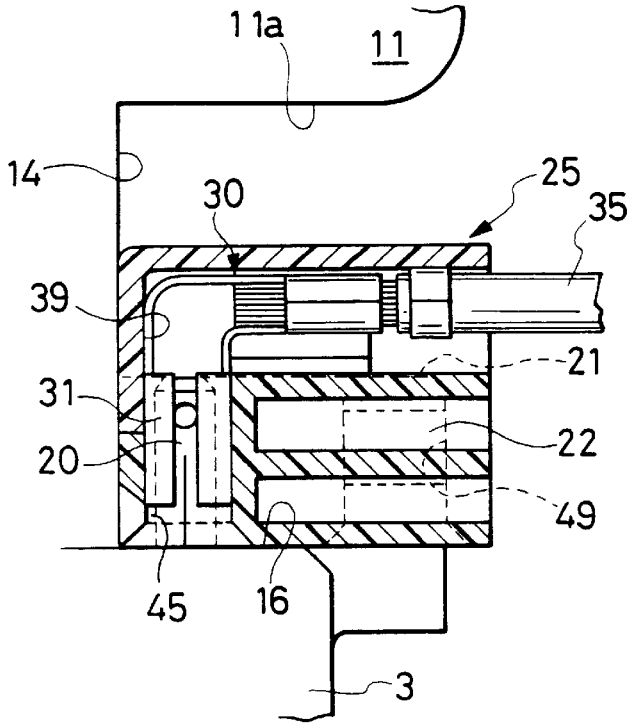
FIG. 6 is a vertical cross-sectional view showing the female connector completely fitted in a direction of the length of the tab portions.
Figure 7:
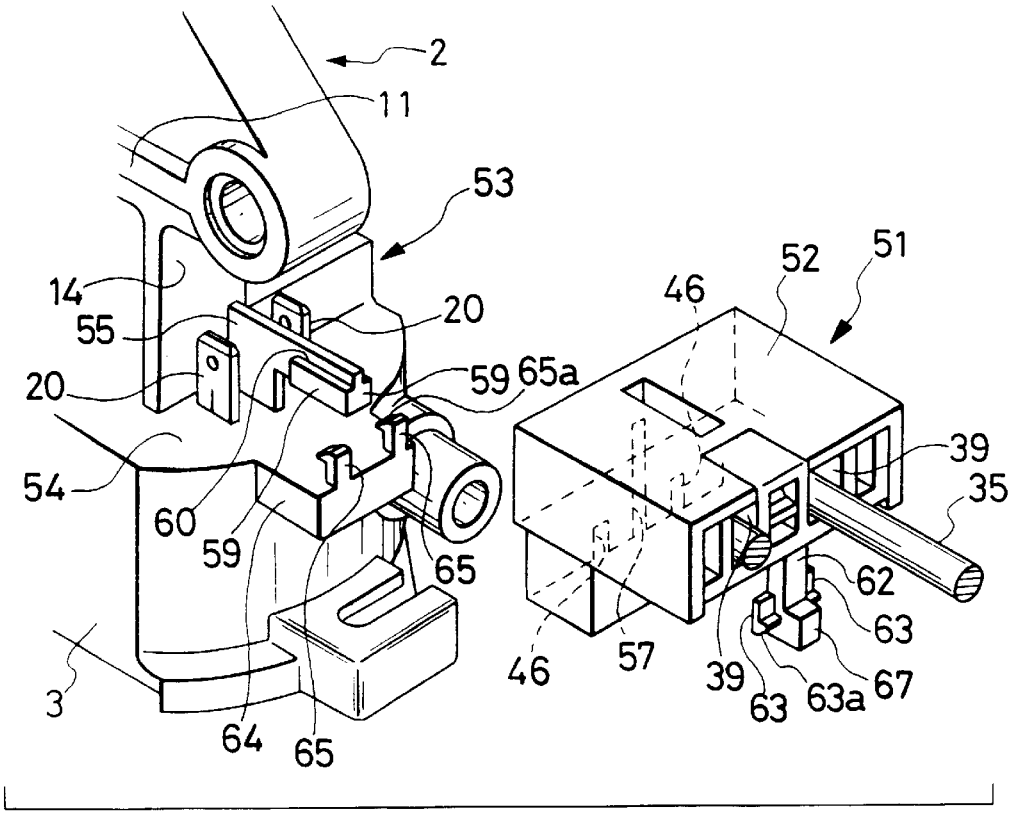
FIG. 7 is an exploded perspective view showing fitting portions of female and male connectors of a second embodiment.

A fitting groove 41 for snugly receiving the guide plate 21 of the male connector 15 is formed in the housing 26 of the female connector 25, and is disposed approximately centrally along the width of the housing 26. The fitting groove 41 opens towards the front surface and bottom surface of the housing 26. Tapering guide surfaces 43 are formed respectively on opposite (right and left) side edges of a front opening 42 of the fitting groove 41, as shown in FIG. 3. More specifically, the fitting groove 41 receives the upper end portion of the guide plate 21 through the front opening 42, and then allows the female connector 25 to be pushed toward the abutment wall 14, with the bottom surface of the female connector 25 being held in sliding contact with the sliding surfaces 23 of the limitation portions 22, as shown in FIG. 4. After the female connector 25 abuts against the abutment wall 14, the fitting groove 41 allows the female connector 25 to move toward the bottom surface 16 of the male connector 15, with the guide plate 21 inserted upwardly deep into the fitting groove 41, as shown in FIG. 6.

A terminal insertion port 45 is defined by that portion of each terminal receiving chamber 39 open to the bottom surface of the housing 26, and the tab portion 20 of the male metal terminal 19 is adapted to be inserted into the terminal receiving chamber 39 through this terminal insertion port 45. When each female metal terminal 30 is received in the associated terminal receiving chamber 39, the distal end of the connection portion 31 is kept spaced a predetermined distance inwardly from the terminal insertion port 45. Specifically, when the female connector 25 is placed on the sliding surfaces 23 of the limitation portions 22 as shown in FIG. 4, the distal end of the connection portion 31 of the female metal terminal 30 is spaced upwardly from the distal end of the tab portion 20 of the male metal terminal 19.

Two insertion grooves 46, as shown in FIGS. 2 and 3, are formed in the front surface of the housing 26, and each insertion groove 46 extends to the corresponding terminal insertion port 45. The upper end portion of the tab portion 20 is shaped to be inserted into the insertion groove 46 from the front side of the housing. Tapering guide surfaces 47 are formed on opposite side edges of the insertion groove 46 and the terminal insertion port 45. When the female connector 25 is held against the abutment wall 14 upon insertion along the limitation portions 22 as shown in FIG. 5, the tab portion 20 is disposed at a central portion of the terminal insertion port 45.

Vertical guide grooves 49 for respectively receiving and guiding the right and left limitation portions 22, as shown in FIG. 4, are formed in inner surfaces of the fitting groove 41 in the female connector 25. The vertical guide grooves 49 are disposed in vertical alignment with the two limitation portions 22, respectively, when the front surface of the female connector 25 is held against the abutment wall 14 (FIG. 5). Front and rear surfaces of the guide groove 49 are spaced by a distance such that the limitation portion 22 can snugly fit in this groove. Tapering guide surfaces 50 are also formed at lower edges of the guide groove 49. Thus, the front and rear surface of the limitation portion 22 can be brought into contact with the front and rear surfaces of the guide groove 49, respectively. As a result, while the female connector 25 is pushed from the position shown in FIG. 5 toward the bottom surface 16 of the male connector 15, the female connector 25 will not shake.

A procedure for assembling this first embodiment of the above construction is described with reference to FIGS. 4 to 6. First, the upper end portion of the guide plate 21 of the male connector 15 is inserted into the fitting groove 41 through the front opening 42 so that the front end portion of the bottom surface of the female connector 25 contacts the sliding surfaces 23 of the two limitation portions 22, as shown in FIG. 4. At this time, even if the female connector 25 is slightly shaken right and left, the tapering surfaces 43 at the front end of the fitting groove 41 are brought into contact with the guide plate 21 so that the female connector 25 is maintained in a vertically aligned position so that it can be inserted. Then, the female connector 25 is pushed toward the abutment wall 14 in a direction of arrow A. The female connector 25 is inserted, with its bottom surface urged against the sliding surfaces 23 of the limitation portions 22, and, as a result, the female connector 25 is pushed parallel to the bottom surface 16 of the male connector 15 without shaking.

When the female connector 25 approaches the abutment wall 14, the tab portion 20 of each male metal terminal 19 is inserted into the terminal insertion port 45 through the insertion groove 46 from the front side. Even if there is a slight misalignment between the tab portion 20 and the insertion groove 46, the tab portion 20 is brought into contact with and guided by the tapering guide surfaces 47 of the insertion groove 46 so that the tab portion 20 is positively fitted in the insertion groove 46. When the front surface of the female connector 25 abuts against the abutment wall 14, the tab portion 20 is inserted into the central portion of the terminal insertion port 45, and is disposed just beneath the connection portion 31 of the female metal terminal 30, as shown in FIG. 5. Also, the two limitation portions 22, formed on the guide plate 21, are disposed just beneath the guide grooves 49, respectively.

When the female connector 25 is then pushed toward the bottom surface 16 of the male connector 15 in a direction of arrow B (FIG. 5), with the guide plate 21 inserted deep into the fitting groove 41, the limitation portions 22 are inserted into the guide grooves 49, respectively. At this time, even if there is a slight misalignment between the limitation portion 22 and the guide groove 49, the upper edge of the limitation portion 22 engages the tapering surface 50 on the edge of the guide groove 49 so that the limitation portion 22 is positively guided into the guide groove 49. The guide groove 49 is so formed that its front and rear surfaces can be held in contact with the front and rear surfaces of the limitation portion 22, respectively. Therefore, the female connector 25 can be pushed straight toward the bottom surface 16 of the male connector 15 without shaking. By pushing the female connector 25, the tab portions 20 are fitted into the connection portions 31 of the female metal terminals 30, respectively, so that the pair of mating female and male metal terminals 30 and 19 are electrically connected together.

Because the mounting leg 11 projects outward over the tab portions 20 of the male connector 15, a sufficient fitting space for the connectors of the prior art is not available such that fitting the female connector 25 from the front side of the male connector is impossible. In this first embodiment, however, the female connector 25 is fitted on the guide plate 21, and can be fitted on the male connector through the L-shaped path. Therefore, if a space in front of the tab portions 20 into which the female connector can be inserted from one side of the space exists, the female connector 25 can be fitted from the position in front of the tab portions 20. As a result, the tab portion 20 and the connection portion 31 of the female metal terminal 30 can be fitted together along the length thereof such that a sufficiently large area of contact between the two is obtained to establish a reliable electrical connection.

Because the female connector 25 is inserted while being pressed against the sliding surfaces 23 of the limitation portions 22, the female connector 25 can be pushed while being maintained in a predetermined posture parallel to the bottom surface 16 of the male connector 15. Therefore, the tab portions 20 can be positively introduced into the terminal insertion ports 45, respectively. The female connector 25 is pushed toward the bottom surface 16 of the male connector 15 without misalignment because of the limitation portions 22 that respectively engage the guide grooves 49. As a result, the tab portion 20 can be properly fitted into the connection 31 of the female metal terminal 30 without gouging.

Figure 8:
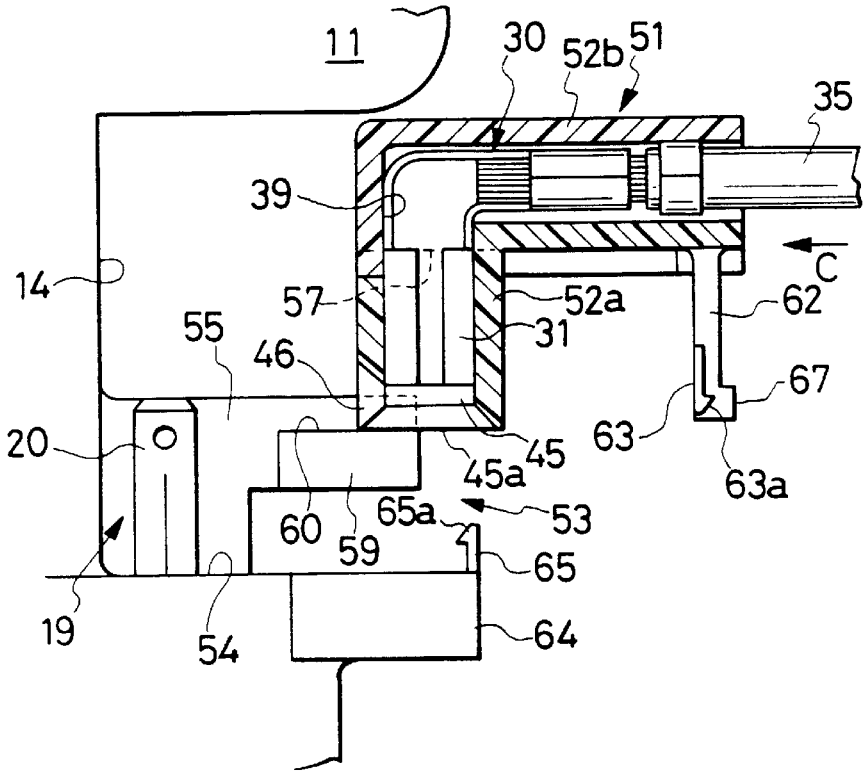
FIG. 8 is a vertical cross-sectional view showing an initial stage of fitting of the female connector.

FIGS. 7 to 11 show a second embodiment of the invention. In this second embodiment, a housing 52 of a female connector 51 for receiving female metal terminals 30 has an L-shaped cross-section as shown in FIG. 8, and terminal receiving chambers 39 of an L-shape are formed in this housing 52 as in the first embodiment.

A male connector 53 that connects with the female connector 51 has a guide plate 55 disposed between two projected tab portions 20 and perpendicular to the abutment wall 14. The guide plate 55 includes a main portion of a predetermined width extending upright from a bottom surface 54 of the male connector 53 to a level or height generally equal to that of the tab portions 20, and an extension projecting outwardly from an upper portion of this main portion. The bottom surface 54 of the male connector 53 projects outwardly in beneath the extension of the guide plate 55.

The housing 52 of the female connector 51 has a fitting groove 57 for receiving the guide plate 55, the fitting groove 57 being disposed centrally along the width of the housing 52. The fitting groove 57 extends through a vertical portion 52*a* (which receives connection portions 31 of female metal terminals 30) of the housing 52 from a front surface thereof to a rear surface thereof in a direction along a length of a bottom surface of a horizontal portion 52*b* of the housing 52. A pair of limitation portions 59 are formed respectively on opposite sides of the extension of the guide plate 55, and an upper surface of each of the limitation portions 59 serves as a sliding surface 60 for establishing sliding contact with an end surface 45*a* (in which terminal insertion ports 45 are formed) of the female connector 51 when the female connector 51 is pushed parallel to the bottom surface 54 of the male connector 53.

The dimension between the sliding surface 60 of each limitation portion 59 and the lower surface 11*a* of the mounting leg 11 is generally equal to the height of the female connector 51. The length of the sliding surfaces 60 is greater than that of the sliding surfaces 23 in the first embodiment so that the female connector 51 can slide over the sliding surfaces 60 immediately before the front surface of the female connector 51 is brought into abutment against the abutment wall 14.

An elastically-deformable support member 62 is formed integrally with and depends from a lower surface of a distal end portion of the horizontal portion 52*b* of the housing 52. The support member 62 is disposed centrally along the width of the horizontal portion 52*b*. A pair of hook-like lock portions 63 are formed on opposite sides of the support member 62, respectively. A pair of hook-like lock piece portions 65 that lock with the respective lock portions 63 are formed on a projected portion 64 projecting from the bottom surface 54 of the male connector 53. The female connector 51 is brought into abutment against the abutment wall 14, and then is pushed into abutment against the bottom surface 54 of the male connector 53 along the abutment wall 14 such that the lock portions 63 are engaged with the lock piece portions 65, respectively. The lock portion 63 and the lock piece portion 65 have tapering surfaces 63*a* and 65*a*, respectively. A push portion 67 is formed at the lower end of the support member 62, and the support member 62 is forcibly flexed through this push portion 67 so as to release the locking engagement.

Other elements of the second embodiment are generally the same as those of the first embodiment, and identical parts are designated respectively by the same reference numerals in each embodiment. Therefore, repeated explanation thereof is omitted here.

A procedure for assembling the second embodiment will now be described with reference to FIGS. 8 to 11. First, the upper end portion of the guide plate 55 is inserted into the fitting groove 57 through a front opening in the female connector 51 so that the front end portion of the end surface 45*a* (to which the terminal insertion ports 45 are open) of the female connector 51 is placed on the sliding surfaces 60 of the two limitation portions 59, as shown in FIG. 8. The female connector 51 is then pushed toward the abutment wall 14 in a direction of arrow C. The female connector 51 is inserted with its end surface 45*a* urged against the sliding surfaces 60 of the limitation portions 59. As a result, the female connector 51 is pushed parallel to the bottom surface 54 of the male connector 53 without shaking.

Figure 9:
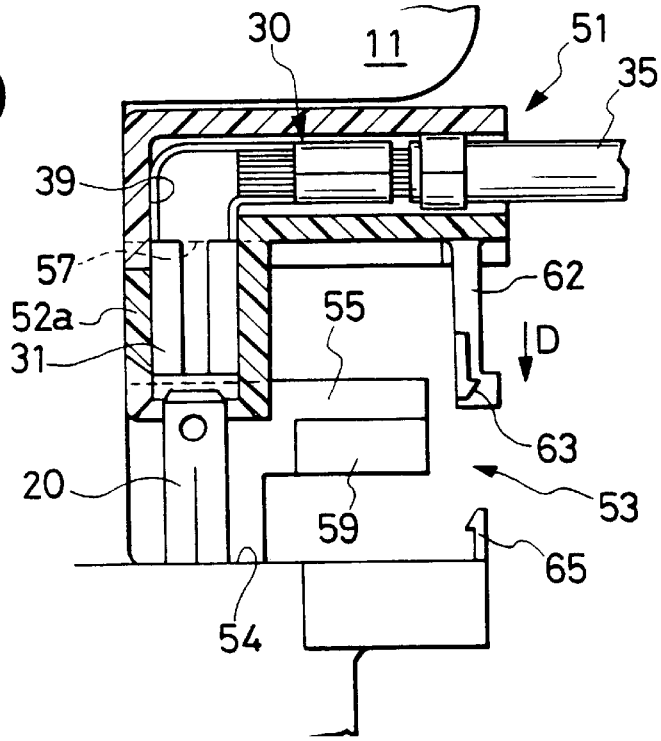
FIG. 9 is a vertical cross-sectional view showing the female connector fitted in a direction perpendicular to tab portions.
Figure 10:
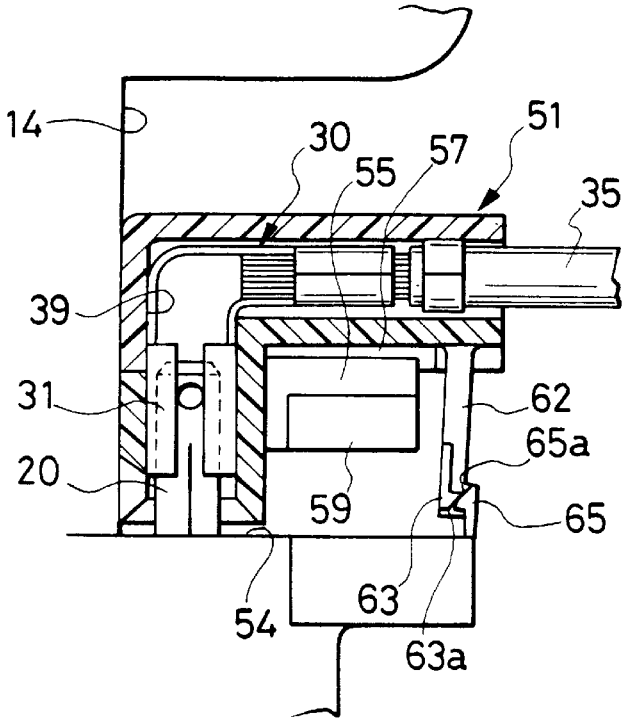
FIG. 10 is a vertical cross-sectional view showing the female connector fitted in a direction of the length of the tab portions immediately before the completion of the fitting operation.

When the female connector 51 approaches the abutment wall 14, the tab portion 20 of each male metal terminal 19 is inserted into the terminal insertion port 45 through an insertion groove 46 from the front side. When the front surface of the female connector 51 abuts against the abutment wall 14, the tab portion 20 is inserted into the central portion of the terminal insertion port 45, and is disposed just beneath the connection portion 31 of the female metal terminal 30, as shown in FIG. 9. The two limitation portions 59 formed on the guide plate 55 are disposed outwardly of the vertical portion 52*a* of the female connector 51, and the lock portions 63 on the female connector 51 are disposed just above the lock piece portions 65, respectively.

The female connector 51 is then pushed toward the bottom surface 54 of the male connector 53 in a direction of arrow D (FIG. 9), with the guide plate 55 inserted deep into the fitting groove 57. At this time, the female connector 51 is pushed with its front surface held in sliding contact with the abutment wall 14. As a result, the female connector 51 can be pushed straight toward the bottom surface 54 of the male connector 53 without shaking. As the female connector 51 is pushed, the tab portions 20 are gradually fitted into the connection portions 31 of the female metal terminals 30, respectively, and the tapering surface 63*a* of each lock portion 63 contacts the tapering surface 65*a* of the associated lock piece portion 65, so that the downwardly-moving support member 62 is elastically deformed.

Figure 11:
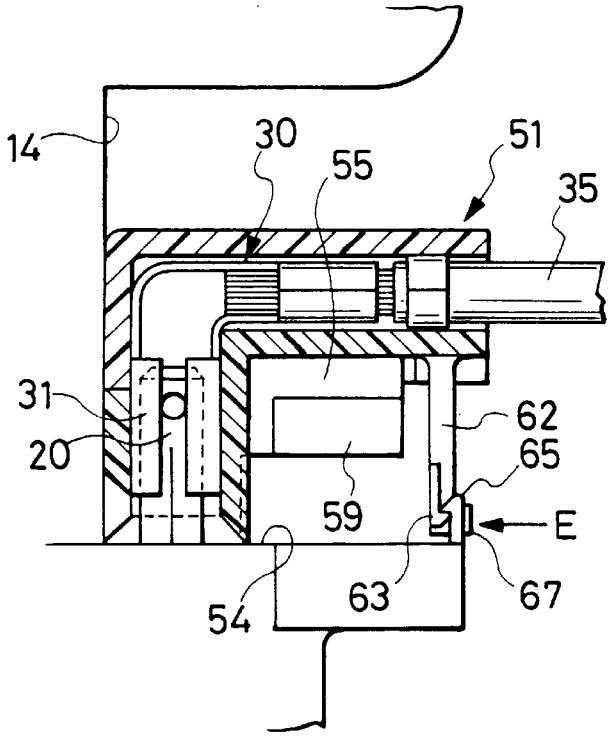
FIG. 11 is a vertical cross-sectional view of a female connector completely fitted to a male connector.

When the female connector 51 is pushed into abutment against the bottom surface 54 of the male connector 53 as shown in FIG. 11, the support member 62 is restored into its original shape, so that the lock portions 63 are lockingly engaged respectively with the lock piece portions 65, and the female connector 51 is secured to the male connector 53 to prevent relative movement. When the female connector 51 and the male connector 53 are connected, each tab portion 20 is fitted deep within the connection portion 31 of the associated female metal terminal 30.

For disconnecting the female connector 51 from the male connector 53, the push portion 67 of the support member 62 is pushed in a direction of arrow E (FIG. 11) to forcibly flex the support member 62 inwardly to disengage the respective lock portions 63 from the lock piece portions 65. The female connector 51 is then guided upwardly along the abutment wall 14 and pulled forward.

As described above, in this second embodiment as in the first embodiment, the female connector 51 can be fitted relative to the male connector through the L-shaped path. Therefore, even if insufficient space exists in front of the tab portions 20, the female connector 51 can be fitted from the position in front of the tab portions 20. Further, each tab portion 20 and the connection portion 31 of the associated female metal terminal 30 can be contacted with each other along the length thereof, thus providing the sufficient area of contact between the two to achieve a reliable electrical connection. The lock mechanism is provided for locking the female connector 51 in its fitted condition, and therefore even if a pulling force acts on a wire 35, the female connector 51 will not be disengaged from the male connector 53.

The present invention is not limited to the above embodiments shown in the drawings. Accordingly, the following embodiments fall within the scope of the present invention. Furthermore, other modifications can be made without departing from the scope of the invention.

For example, in the first embodiment, during the insertion of the female connector 25 toward the abutment wall 14, if the upper surface of the female connector 25 is held in sliding contact with the lower surface 11*a* of the mounting leg 11, the female connector 25 can be pushed without shaking. Also, during the insertion of the female connector 25 toward the bottom surface 16 of the male connector 15, if the front surface of the female connector 25 is held in sliding contact with the abutment wall 14, the female connector 25 can be pushed without shaking. Namely, the lower surface 11*a* of the mounting leg 11 and the abutment wall 14 perform the function of the limitation portions 22. Therefore, the limitation portions 22 can be omitted.

According to the present invention, in contrast with the embodiments described above, the female connector instead of the male connector can be connected to the motor.

The present invention can be applied not only to the connector device for direct connection to the motor but also to electrical connection constructions of the general type employing female and male connectors in which the fitting space is limited.

What is claimed is:

1. An electrical connector assembly comprising:

a male connector having a male connector housing with a terminal side through which male terminals extend;

a female connector with a female connector housing with female terminals disposed to connect with the male terminals through a terminal side of the female connector housing;

a guiding portion that guides one of the male connector and the female connector in a guiding direction that intersects a normal axis extending perpendicular to the terminal side of the other of the male connector and the female connector the guiding portion including a guide plate attached to the other of the male connector and the female connector and a guide plate groove shaped to receive the guide plate and form in the guided one of the male connector and the female connector; and a positioning portion that stops the guided one of the male connector and the female connector upon contact with the positioning portion in an alignment position such that the male terminals of the male connector are aligned with the female terminals of the female connector, the female connector being movable relative to the male connector in a direction along the normal axis to engage the male and female terminals, the male connector being stationary when the female terminal engages the male terminal.

2. The electrical connector assembly of claim 1, wherein the guided one of the male connector and the female connector is disposed relative to the other of the male connector and the female connector such that the guiding direction is substantially perpendicular to the normal axis extending from the terminal side of the other of the male connector and the female connector.

3. The electrical connector assembly of claim 1, wherein the positioning portion includes a positioning member shaped to contact the housing of the guided one of the male connector and the female connector to stop the guided one of the male connector and the female connector.

4. The electrical connector assembly of claim 1, wherein the guiding portion includes a limitation portion and the guide groove is shaped to receive the limitation portion in the alignment position such that the limitation portion engages the guide groove when the male connector and the female connector are urged together, the guided one of the male connector and the female connector being in sliding contact with at least the positioning member.

5. The electrical connector assembly of claim 4, wherein the guide groove extends approximately perpendicular to the guiding direction such that engagement between the guide groove and the limitation portion prevents movement of the guided one of the male connector and the female connector in the guiding direction.

6. The electrical connector assembly of claim 1, wherein the guided one of the male connector and the female connector is disposed relative to the other of the male connector and the female connector such that the guiding direction is substantially perpendicular to the normal axis extending from the terminal side of the other of the male connector and the female connector.

7. The electrical connector assembly of claim 6, wherein the positioning portion includes a positioning member shaped to contact the housing of the guided one of the male connector and the female connector to stop the guided one of the male connector and the female connector.

8. The electrical connector assembly of claim 7, further comprising a locking mechanism that locks the male connector and the female connector to each other when the male connector and the female connector in the alignment position are urged towards each other.

9. The electrical connector assembly of claim 8, wherein the locking mechanism includes locking members attached to the male connector and corresponding locking members attached to the female connector, and wherein the locking members are disposed to engage the corresponding locking members when the male connector and the female connector in the alignment position are urged towards each other.

10. The electrical connector assembly of claim 1, further comprising a locking mechanism that locks the male connector and the female connector to each other when the male connector and the female connector in the alignment position are urged towards each other.

11. The electrical connector assembly of claim 4, further comprising a locking mechanism that locks the male connector and the female connector to each other when the male connector and the female connector in the alignment position are urged towards each other.

12. The electrical connector assembly of claim 1, wherein the guide plate projects by a first height from the terminal side between the terminals of one of the male connector and the female connector.

13. The electrical connector of claim 12, wherein the guide plate includes guide surfaces disposed on at least one side of the guide plate at a second height less than the first height, the guide surfaces slidably supporting the guided one of the male connector and the female connector.

14. The electrical connector of claim 13, wherein the guide surfaces include limitation portions that protrude outward from the guide plate in a direction approximately perpendicular to the guiding direction.

15. The electrical connector of claim 14, wherein the positioning portion is an abutment wall that contacts the guided one of the male connector and the female connector, the abutment wall being disposed approximately parallel to the terminals of and perpendicular to the terminal side of the other of the male connector and the female connector.

16. The electrical connector assembly of claim 12, wherein the terminals of the female connector are L-shaped and include female terminal end portions disposed approximately perpendicular to female terminal wire connection portions.

17. A method of joining a first connector to a mating second connector such that respective terminals of the first and second connectors establish electrical contact, at least one of the first and second connectors having a guiding portion and at least one of the first and second connectors having a positioning portion, the method comprising:

guiding one of the first connector and second connector with the guiding portion in a guiding direction that intersects a normal axis that is parallel to the terminals of the other of the first connector and second connector, one of the first connector and the second connector including a limitation portion and the other of the first connector and the second connector including a guide groove shaped to receive the limitation portion;

stopping the guided one of the first connector and the second connector by contact with the positioning portion such that the terminals of the first connector are aligned with the terminals of the second connector, one of the first and second connectors being moveable relative to one another in a direction along the normal axis to engage the terminals of the first and second connectors, the other one of the first and second connectors being stationary when the terminals of the first and second connectors establish electrical contact said stopping further including aligning the limitation portion with the guide groove; and urging the first connector and the second connector together in a direction along the normal axis into an engagement position such that the respective terminals contact each other.

18. The method of claim 17, wherein the step of urging includes locking the first connector and the second connector in the engagement position.

19. The method of claim 17, wherein the step of stopping includes contacting a housing of the guided one of the first connector and the second connector with the positioning portion.

20. The method of claim 17, wherein the step of guiding includes guiding one of the first connector and the second connector in the guiding direction approximately perpendicular to the normal axis.

21. The method of claim 17, wherein the step of urging includes engaging the limitation portion with the guide groove as the first connector and second connector are urged together.

* * * * *